US007038367B2

(12) United States Patent
Choi et al.

(10) Patent No.: US 7,038,367 B2
(45) Date of Patent: May 2, 2006

(54) ELECTRON GUN FOR CATHODE RAY TUBE INCLUDING ELECTRODES WITH DIFFERENT DIMENSIONS

(75) Inventors: Jong-Hoon Choi, Yongin (KR); Min-Cheol Bae, Yongi (KR)

(73) Assignee: Samsung SDI Co., Ltd., Suwon (KR)

( * ) Notice: Subject to any disclaimer, the term of this patent is extended or adjusted under 35 U.S.C. 154(b) by 201 days.

(21) Appl. No.: 10/629,714

(22) Filed: Jul. 30, 2003

(65) Prior Publication Data

US 2004/0041527 A1 Mar. 4, 2004

(30) Foreign Application Priority Data

Aug. 29, 2002 (KR) ..... 10-2002-0051541

(51) Int. Cl.
*H01J 29/02* (2006.01)
*H01J 29/46* (2006.01)

(52) U.S. Cl. ..... 313/414; 313/448; 315/382

(58) Field of Classification Search ..... 313/238, 313/247, 251, 260, 412–414, 460, 447–448, 313/409; 315/15, 382
See application file for complete search history.

(56) References Cited

U.S. PATENT DOCUMENTS 5,677,590 A * 10/1997 Matsuda et al. ..... 313/412
6,353,282 B1 * 3/2002 Tojyou et al. ..... 313/441
6,642,646 B1 * 11/2003 Kwon ..... 313/414
6,819,038 B1 * 11/2004 Song et al. ..... 313/409

FOREIGN PATENT DOCUMENTS

KR 1020010018045 3/2001
KR 1020010057789 7/2001

* cited by examiner

*Primary Examiner*—Karabi Guharay
(74) *Attorney, Agent, or Firm*—H.C. Park & Associates, PLC

(57) ABSTRACT

An electron gun for a cathode ray tube includes a triode portion including cathodes, a first electrode, and a second electrode arranged with predetermined gaps therebetween. A plurality of electrodes arranged in sequence starting from a position adjacent to the second electrode. The electrodes receiving a voltage, for example, a constant voltage or a dynamic voltage. The dynamic voltage is synchronized with a deflection signal of electron beams. An anode electrode is positioned having a predetermined gap between the electrode arranged farthest from the cathodes. A support maintains the electrodes at predetermined intervals. One of the electrodes is a multiple-element electrode that includes two interconnected sub-electrodes. Gaps are formed between portions the sub-electrodes of the multiple-element electrode.

19 Claims, 6 Drawing Sheets

ELECTRON GUN FOR CATHODE RAY TUBE INCLUDING ELECTRODES WITH DIFFERENT DIMENSIONS

This application claims the benefit of Korean Patent Application No. 2002-0051541, filed on Aug. 29, 2002, which is hereby incorporated by reference for all purposes as if fully set forth herein.

BACKGROUND OF THE INVENTION

1. Field of the Invention

The present invention relates to an electron gun for a cathode ray tube, and more particularly, to an electron gun for a cathode ray tube driven using a dynamic focus method.

2. Discussion of the Related Art

The resolution of a cathode ray tube (CRT) is determined by characteristics of the electron beams. The characteristics include the focal point characteristics of the electron beam. In order to obtain quality images on the display, the electron beams landing on the phosphor screen must land on all areas of the phosphor screen. For example, the electron beams must land on the center and peripheral portions of the screen and have a small halo.

In the related art CRTs the electron beam holes for red (R), green (G), and blue (B) electron beams are arranged in an in-line configuration. A magnetic field is used to deflect electron beams into a pin cushion shape for a horizontal deflection and a barrel shape for vertical deflection. As a result, the focal point of the electron beams landing in the peripheries of the screen is distorted by astigmatism, which is caused by the non-uniform magnetic fields formed in the deflection apparatus. A reduction in the CRT resolution is caused by the distortion of the focal points of the electron beams in scanning peripheries and center, that is these focal points are different.

Accordingly, a dynamic focus electron gun is employed in the related art CRTs to remedy this problem. Dynamic focusing refers to the application of a dynamic focus voltage. The dynamic focus voltage creates a higher focus voltage than the normal focus voltage when the peripheries of the screen are scanned by the electron beams. Accordingly, the focal point formation on the peripheries is compensated using this technique.

The electrons to which the dynamic focus voltage is applied are typically realized through two interconnected electrodes. The electrodes may be cup-shaped and/or plate-shaped or any combination thereof, and are generally welded together.

An electromagnetic field is formed in the area of the electron gun by a deflection magnetic field formed by the deflection apparatus. The voltage is synchronized with the horizontal deflection magnetic field signal, that is a part of the deflection magnetic field, and applied to the dynamic focus electrodes.

However, in the related art dynamic focus CRT systems, noise is generated in the area of the electron gun and interferes with the operation of the device, thereby reducing the quality of the device. Vibration of the dynamic focus electrodes generates the noise and the vibration is caused by a dynamic focus voltage applied to the electrodes. However, the dynamic focus voltage generates the electromagnetic field and electromagnetic force and causes the electrodes to vibrate.

Korean Laid-Open Patent No. 2001-0018045 discloses such a dynamic focus electron gun. Further, there is disclosed in Korean Laid-Open Patent No. 2001-0057789 an electron gun for a color Braun tube that improves an insertion depth structure of electrodes with respect to bead glass, and a structure for wires connected to electrodes and stem pins to reduce the noise.

However, in the above related art electron guns, the structure directly responsible for the generation of noise is not altered. Instead the structure in the general area is improved (i.e., the insertion sections of the electrodes that are inserted into the bead glass or the wire structure). Therefore, only a minimal reduction in noise is realized.

Noise is generated by the electrodes of the electron gun at specific frequencies, for example, at 7.4 kHz or 12 kHz. If an attempt is made to reduce noise by varying the specific frequency in the indirect and not the direct area of the noise source, that is, in the path through which the vibrations caused by the noise occur, then it becomes difficult to vary the frequency with respect to the noise source. Further, if the vibrations caused by the noise source pass through a path other than the one normally taken, then the effectiveness in reducing the vibrations through conventional methods decreases considerably.

SUMMARY OF THE INVENTION

It is an aspect of the present invention to provide an electron gun for a cathode ray tube that reduces noise caused by a dynamic focus voltage.

An electron gun for a cathode ray tube includes a triode portion including cathodes, a first electrode, and a second electrode arranged with predetermined gaps therebetween. A plurality of electrodes arranged in sequence starting from a position adjacent to the second electrode. The electrodes receiving a voltage, for example, a constant voltage or a dynamic voltage. The dynamic voltage is synchronized with a deflection signal of electron beams. An anode electrode is positioned having a predetermined gap between the electrode arranged farthest from the cathodes. A support for supporting the electrodes at predetermined intervals. One of the electrodes is a multiple-element electrode that includes two interconnected sub-electrodes. Gaps are formed between the sub-electrodes of the multiple-element electrode. The electrode may receive a constant voltage or a dynamic voltage, which is synchronized with a deflection signal of electron beams.

The sub-electrodes of the multiple-element electrode may be cup-shaped and/or plate shaped or any combination. The cup-shaped sub-electrodes have different dimensions, and the gaps are formed between ends of the sub-electrodes. The sub-electrodes may include a container having electron beam passage holes and a flange is formed extending from a circumference of an opening of the container. Additionally, the sub-electrode may include insertion members formed extended from the flange, the insertion members may be fixedly inserted into the support.

The cup-shaped sub-electrodes may have at least one identical dimensions and the gap may be formed between circumferences of the sub-electrodes. Protrusions may be formed on opposing surfaces of the cup-shaped sub-electrodes for connecting the sub-electrodes and forming a gap between the sub-electrodes.

In another aspect, one of the sub-electrodes of the multiple-element electrode is cup-shaped and the other sub-electrode is plate-shaped. The cup-shaped sub-electrode and the plate-shaped sub-electrode have at least one substantially identical dimension. A gap may be formed between circumferences of the sub-electrodes. Protrusions may be formed on opposing surfaces of the cup-shaped sub-electrodes, and the sub-electrodes are connected with the protrusions in such a way to form a gap.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to various embodiments of the present invention, examples of which are illustrated in the accompanying drawings.

Figure 1:
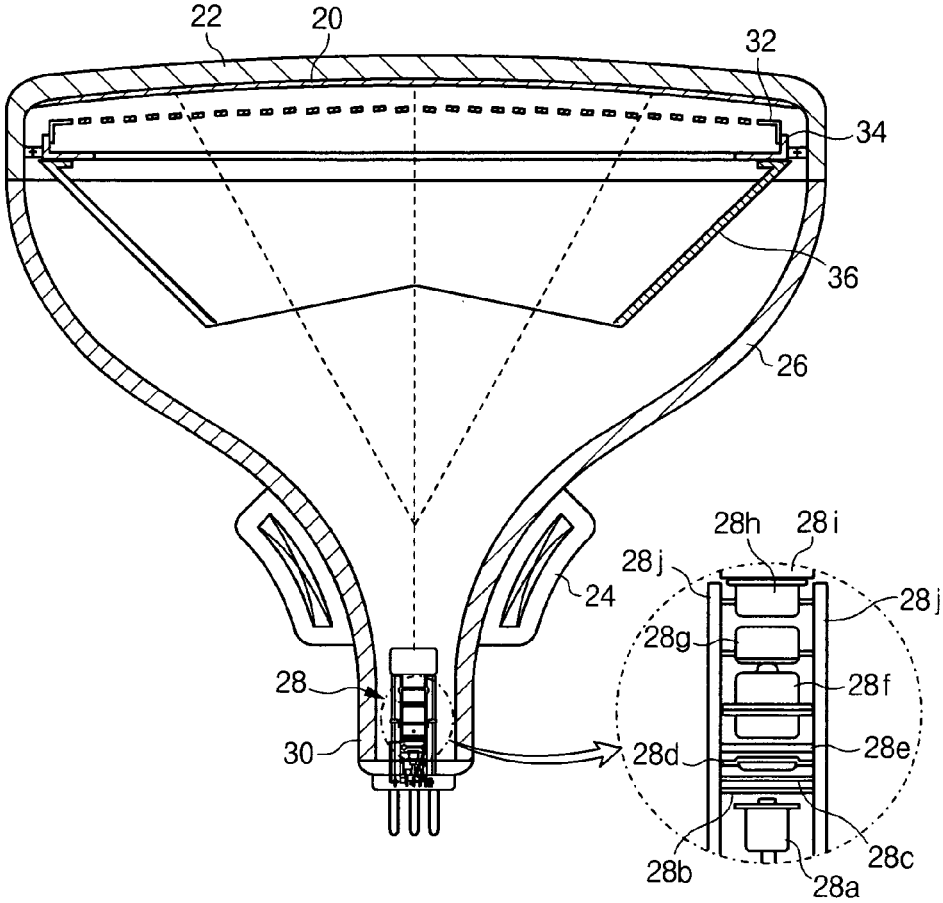
FIG. 1 is a sectional view of a cathode ray tube according to an embodiment of the present invention.

FIG. 1 is a sectional view of a cathode ray tube according to an embodiment of the present invention.

Referring to FIG. 1, the CRT includes a panel 22 having a screen 20 formed on an inner surface of the panel 22, and a funnel 26 that may be connected to the panel 22. The screen 20 may include phosphor or any other suitable material. A deflection apparatus 24 may be arranged on a portion of the outer circumference of the funnel 26. A neck 30 may be connected to the funnel 26 and an electron gun 28 may be arranged therein.

A mask assembly may be arranged inwardly from the panel 22. The mask assembly includes a shadow mask 32 having a plurality of electron beam apertures formed therein, and a mask frame 34 for supporting the shadow mask 32. Further, an inner shield 36 may be connected to the mask frame 34 for shielding electron beams emitted from the electron gun 28 from the earth's magnetic field, when the electron beams are traveling toward the screen 20.

The electron gun 28 may be structured arranging three red (R), green (G), and blue (B) electron beam holes in an in-line configuration and adopts a dynamic focus method for operation. This will be described in more detail below.

The electron gun 28 forms a triode portion that includes cathodes 28*a*, a first electrode 28*b*, and a second electrode 28*c* arranged in this sequence with predetermined gaps between them. There are three of the cathodes 28*a* that are arranged in a line configuration corresponding to each of the R, G, B colors. Electron beam passage holes are formed in the first electrode 28*b* and the second electrode 28*c* corresponding to the cathodes 28*a*.

A plurality of electrodes 28*d*, 28*e*, 28*f*, and 28*g* are provided in this sequence starting after the second electrode 28*c*. These electrodes 28*d*, 28*e*, 28*f*, and 28*g* form a dynamic lens during operation of the electron gun 28. Electron beam passage holes are formed in the electrodes 28*d*, 28*e*, 28*f*, and 28*g* in a line and corresponding to the cathodes 28*a*, similar to those formed in the first electrode 28*b* and the second electrode 28*c*. The electrode 28*e* may be formed as a single unit. The electrode 28*g* may be formed of two sub-electrodes 280*g* and 282*g* (see FIG. 2).

During operation of the electron gun 28 a constant voltage (Vf) or a dynamic voltage (Vd) synchronized with a deflection signal of the deflection apparatus 24, is applied to the electrodes. The dynamic voltage (Vd) refers to a varied voltage. That is, when the electron beams are deflected toward peripheries of the screen 20 the resulting spot of the electron beams is substantially identical to the electron beam on a center of screen 20.

The electron gun 28 also includes an anode electrode 28*h* arranged adjacent to the electrode 28*g* and positioned farthest away from the cathodes 28*a*. There is a predetermined gap between the anode electrode 28*h* and the electrode 28*g*. An anode voltage (Ve) is applied to the anode electrode 28*h* through a shield cup 28*i* which is connected to the anode electrode 28*h*. A support 28*j* for supporting the electron gun 28 as described above. The support 28*j* may be made of bead glass or other suitable material, thereby forming a single integral assembly.

Electron beams generated by the triode section of the electron gun 28 pass through the above plurality of electrodes to be focused and accelerated toward the screen 20, to display predetermined images.

The following structure is used in a embodiment of the present invention to reduce noise generated during operation of the electron gun 28. In particular, the electrode 28*g* formed of two sub-electrodes 280*g* and 282*g* as described above, is arranged such that there are gaps formed between the sub-electrodes 280*g* and 282*g*.

Figure 2:
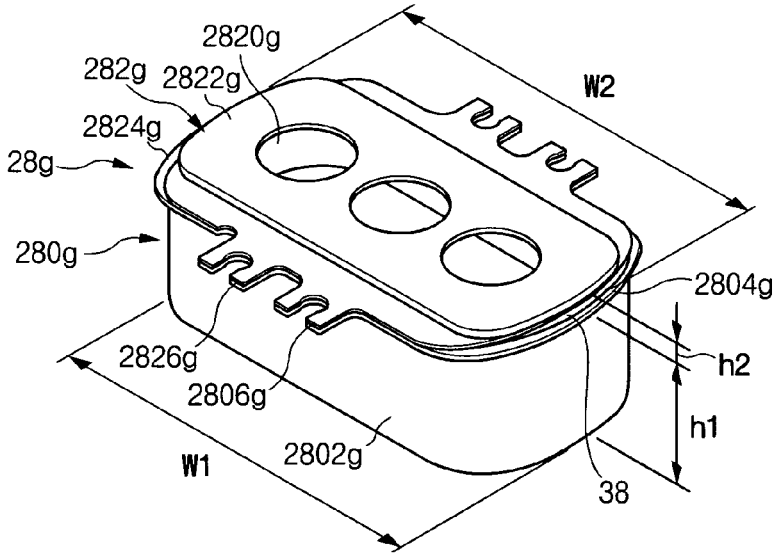
FIG. 2 is a perspective view of electron gun electrodes according to an embodiment of the present invention.

FIG. 2 is a perspective view of electron gun electrodes according to an embodiment of the present invention. In this embodiment the electrode arranged in the electron gun 28 may be formed from separate elements. That is, the electrode includes the sub-electrodes 280*g* and 282*g*. The sub-electrodes 280*g* and 282*g* are connected by welding or any other suitable method. These two sub-electrodes 280*g* and 282*g* may be both cup-shaped having different lengthwise dimensions (w1) and (w2). The sub-electrodes 280*g* and 282*g* include containers 2802*g* and 2822*g*. The containers may include electron beam passage holes 2820*g*, flange 2804*g*, flange 2824*g* arranged around a circumference of the containers 2802*g* and 2822*g*, and insertion members 2806*g* and 2826*g* arranged on the flanges 2804*g* and 2824*g* on opposite sides of the containers 2802*g* and 2822*g*. The insertion members 2806*g* and 2826*g* are arranged into the support 28*j* during manufacture of the electron gun 28. Further, the containers 2802*g* and 2822*g* may be formed to different heights (h1) and (h2), respectively.

In this multiple-element electrode 28*g* according to this embodiment, gaps 38 may be formed between the sub-electrodes 280*g* and 282*g*. The sub-electrodes 280*g* and 282*g* are arranged into a single electrode by welding or any other suitable method. The sub-electrodes 280*g* and 282*g* are arranged such that the insertion members 2806*g* and 2826*g* are in a state where portions of the flanges 2804*g* and 2824*g* are in close contact and the gaps 38 are formed between other areas of the flanges 2804*f* and 2824*g*. For example, gaps 38 are formed at the ends of the sub-electrodes 280*g* and 282*g*.

A CRT that employs in its electron gun the electrode 28*g* as described has a substantial reduction in noise generation as compared to the related art CRT.

Figure 3:
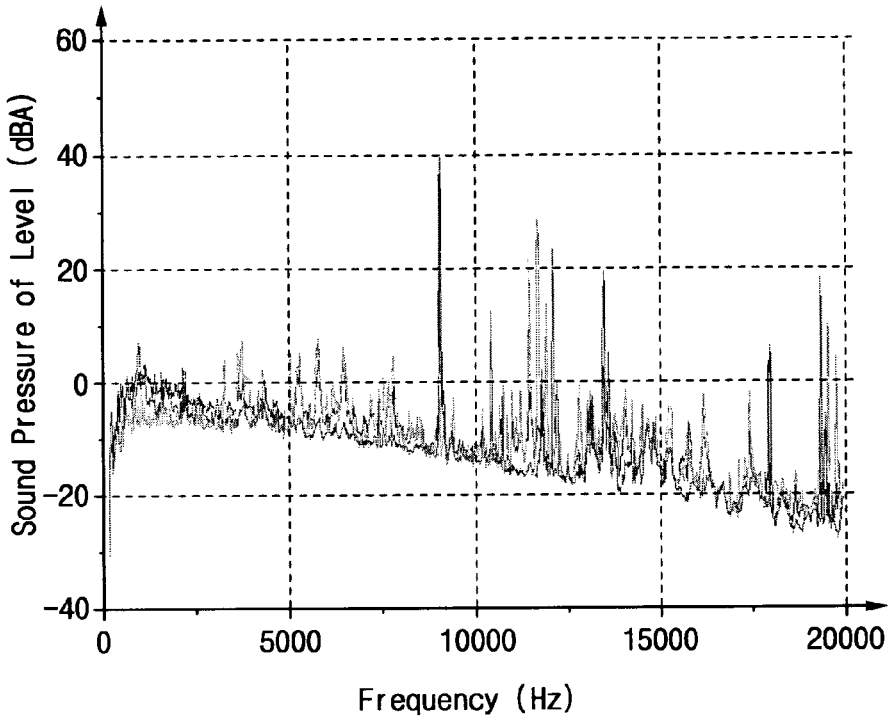
FIG. 3 is a graph illustrating the relationship between a sound pressure level (dBA) and frequency (Hz) of an electron gun according to a comparative example of the present invention.
Figure 4:
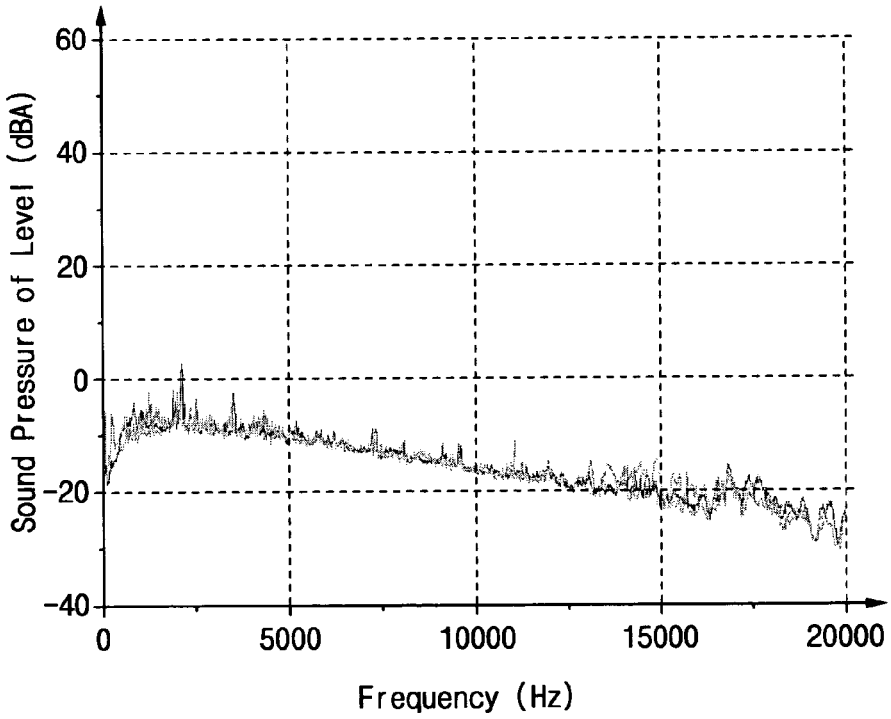
FIG. 4 is a graph illustrating the relationship between a sound pressure level (dBA) and frequency (Hz) of an electron gun according to an embodiment of the present invention.

FIG. 3 is a graph illustrating the relationship between a sound pressure level (dBA) and frequency (Hz) of an electron gun according to a comparative example of the present invention. FIG. 4 is a graph illustrating the relationship between a sound pressure level (dBA) and frequency (Hz) of an electron gun according to an embodiment of the present invention. Referring to FIGS. 3 and 4, the electron gun of the present invention emits noise that is at or below 0 dBA (A weighted decibel) at almost all frequencies. The electron gun of the comparative example generates noise that exceeds 0 dBA at a significant number of the frequencies and at all levels of frequencies. Accordingly, the electron gun of the present invention is able to operate with a substantial reduction of noise and at a level that is inaudible to the human ear.

That is, by providing the gaps 38 between the sub-electrodes 280*g* and 282*g* that make up the multiple-element electrode 28*g*, friction between the sub-electrodes 280*g* and 282*g* caused by vibrations generated in the electrode 28*g* are reduced by the gaps 38, thereby minimizing the noise.

In the following embodiment variations of forming sub-electrodes and variations of the gap locations formed in the electrode will be described. However, a description of the operation will not be provided as the operation of the embodiments to be described is identical to that of the foregoing embodiment.

Figure 5:
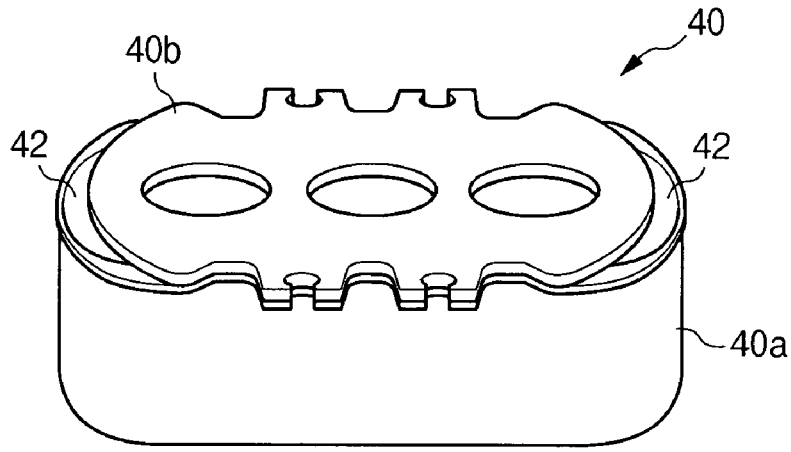
FIG. 5 is a perspective view of a multiple-element electrode for an electron gun according to another embodiment of the present invention.

FIG. 5 is a perspective view of a multiple-element electrode for an electron gun according to another embodiment of the present invention. Referring to FIG. 5, the multiple-element electrode 40 includes a cup-shaped sub-electrode 40*a* and a plate-shaped sub-electrode 40*b*. Any combination of the electrodes may also be utilized. That is, the electrodes may be any combination of the cup-shaped sub electrode and plate-shaped sub electrode. For example, both electrodes may be cup-shaped or plate-shaped. Alternatively, the sub-electrodes may be cup-shaped and plate-shaped in any order. Sub-electrode 40*a* and sub-electrode 40*b* are arranged such that gaps 42 are formed near the end of the electrode 40. The gap 42 configuration is substantially identical to that described above with respect to the previous embodiment.

Figure 6:
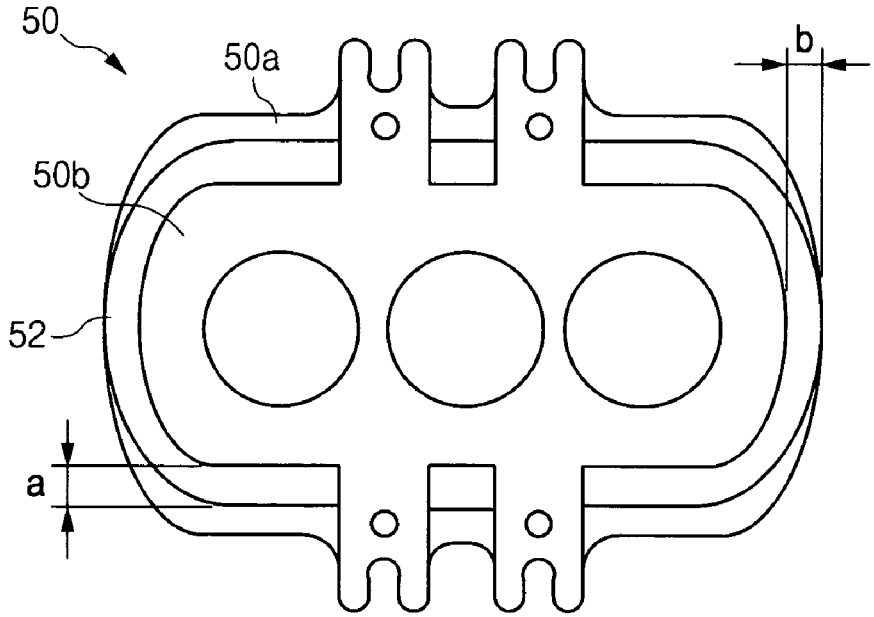
FIG. 6 is a plan view of a multiple-element electrode for an electron gun according to another embodiment of the present invention.

FIG. 6 is a plan view of a multiple-element electrode for an electron gun according to another embodiment of the present invention. Referring to FIG. 6, the multiple-element electrode 50 includes a cup-shaped sub-electrode 50*a* and plate-shaped sub-electrode 50*b*. In this embodiment a gap 52 is formed between and around the entire circumference of the sub-electrodes 50*a* and 50*b*. That is, a gap having a distance (a) and a distance (b) is formed between the sub-electrodes 50*a* and 50*b*. The gaps may be formed to be substantially identical to or greater than the thickness of the sub-electrodes 50*a* and 50*b*. This provides for a degree of error during manufacture or assembly, for example 0.1 mm.

Figure 7:
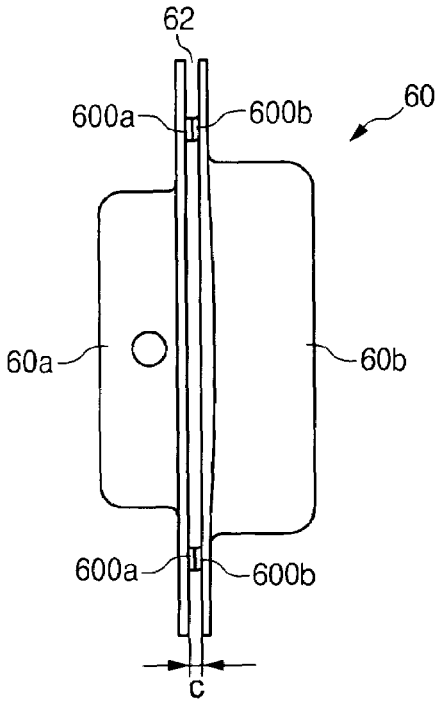
FIG. 7 is a side view of a multiple-element electrode for an electron gun according to another embodiment of the present invention.

FIG. 7 is a side view of a multiple-element electrode for an electron gun according to another embodiment of the present invention. Referring to FIG. 7, the multiple-element electrode 60 includes two cup-shaped sub-electrodes 60*a* and 60*b*. In this embodiment, the sub-electrode 60*a* and sub-electrode 60*b* are arranged so that they do not come into contact with one another Protrusions 600*a* and 600*b* are formed on opposing surfaces of sub-electrode 60*a* and sub-electrode 60*b*, respectively. The protrusions 600*a* and 600*b* contact each other and are welded in this state. Any other suitable attachment method may be employed to attach the protrusions. A gap 62 is formed between the sub-electrode 60*a* and the sub-electrode 60*b*.

Figure 8:
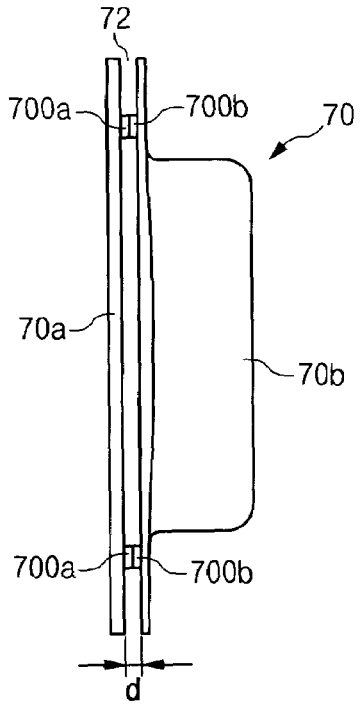
FIG. 8 is a side view of a multiple-element electrode for an electron gun according to another embodiment of the present invention.

FIG. 8 is a side view of a multiple-element electrode for an electron gun according to a another embodiment of the present invention. FIG. 8 illustrates a multiple-element electrode 70 that includes two sub-electrodes 70*a* and 70*b*. The sub-electrode 70*a* is plate-shaped while the sub-electrode 70*b* is cup-shaped. Protrusions 700*a* and 700*b* are formed on opposing surfaces of the sub-electrodes 70*a* and 70*b*, respectively. The protrusions 700*a* and 700*b* are in contact with each other and are welded in this state. Any other suitable attachment method may be employed to attach the protrusions. A gap 70 is formed between the sub-electrode 70*a* and the sub-electrode 70*b*.

Figure 9:
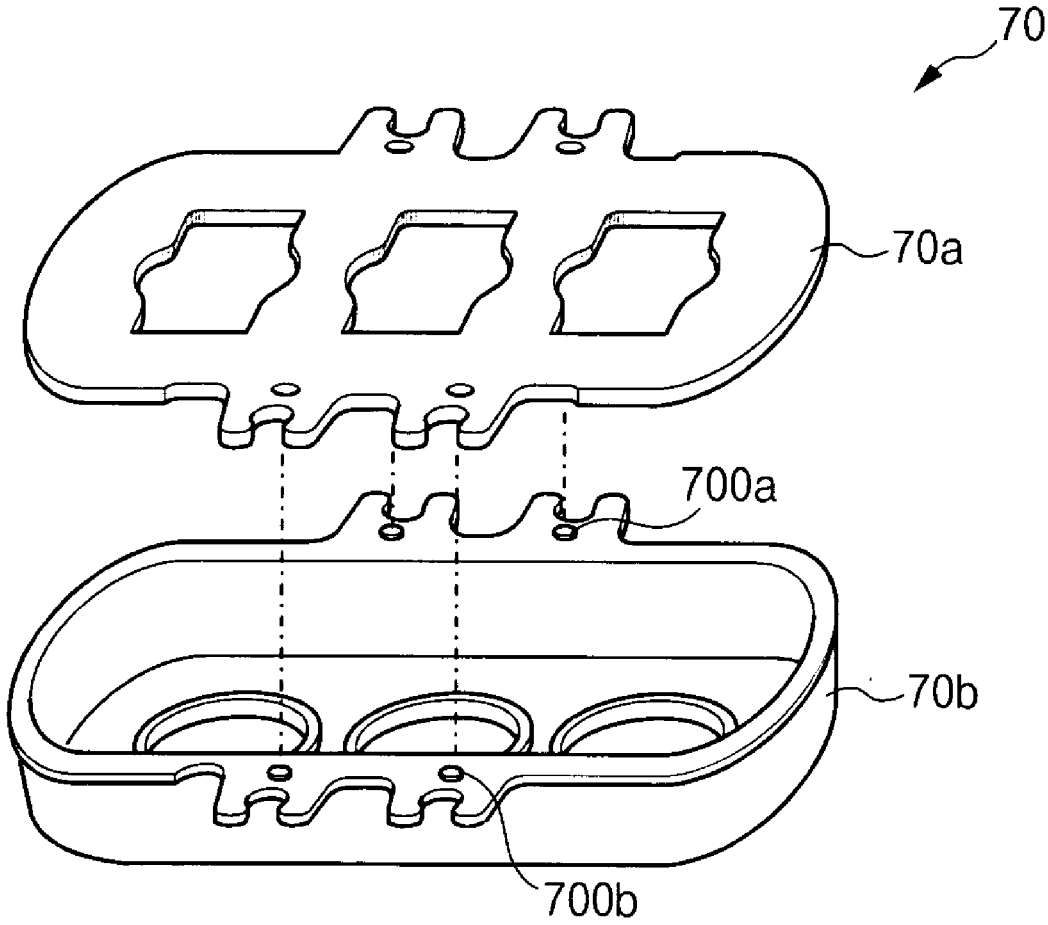
FIG. 9 is an exploded perspective view of a multiple-element electrode for an electron gun according to another embodiment of the present invention.

FIG. 9 is an exploded perspective view of a multiple-element electrode for an electron gun according to another embodiment of the present invention. Referring to FIG. 9, the sub-electrodes 70*a* and 70*b* have substantially the same outer dimensions as shown in FIG. 4 of the present invention.

In the multiple-element electrode 60 according to an aspect of the present invention, the gap 62 size (c) and the gap 72 size (d) are greater than the thickness of at least one of the two sub-electrodes, thereby preventing deformation of the electrodes 60 and 70 by the electric fields formed in the area of the electrodes 60 and 70 during operation. The deformation causes undesirable frictions. The gap 62 size (c) and the gap 72 size (d) may be approximately three or more times thicker than at least one of the two sub-electrodes. That is, sub-electrodes 60*a*, 60*b*, 70*a* or 70*b*, which make up the electrodes 60 and 70, respectively substantially prevents weakness in the electrodes 60 and 70 and substantially prevents permeation of an electric field through the gaps 62 and 72.

Figure 10:
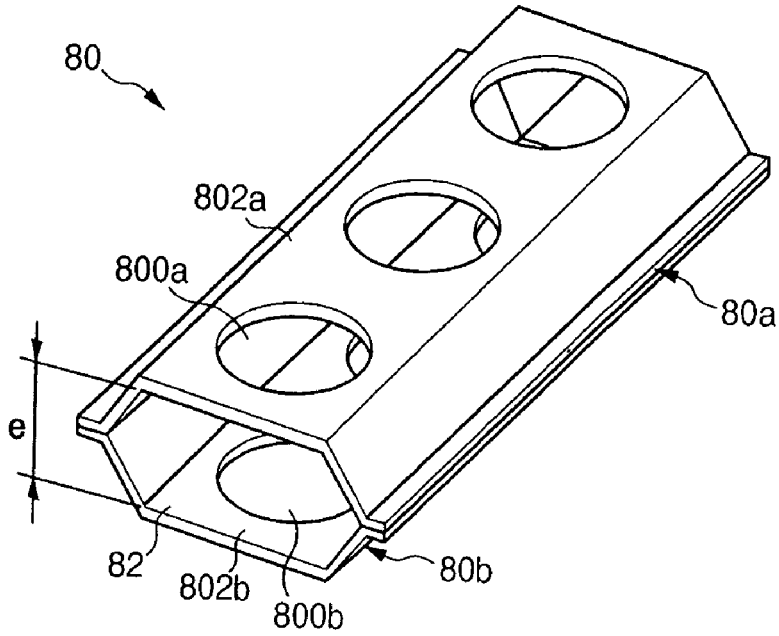
FIG. 10 is a perspective view of a multiple-element electrode for an electron gun according to another embodiment of the present invention.

FIG. 10 is a perspective view of a multiple-element electrode for an electron gun according to another embodiment of the present invention. Referring to FIG. 10, the multiple-element electrode 80 includes sub-electrodes 80*a* and 80*b* that are interconnected, thereby forming a gap 82 between the sub-electrodes 80*a* and 80*b*. The sub-electrodes 80*a* and 80*b* have substantially rectangular surfaces 802*a* and 802*b* and include electron beam passage holes 800*a* and 800*b* formed through the surfaces 802*a* and 802*b*, respectively. The multiple-element electrode 80 may be formed by forming the sub-electrodes 80*a* and 80*b* in a flat rectangular configuration. For example, the formation may be accomplished by bending the rectangular configuration into insertions members and surfaces 802*a* and 802*b* and the insertion members are arranged together and welded. Additionally, any other suitable method could also be used in the formation process.

Figure 11:
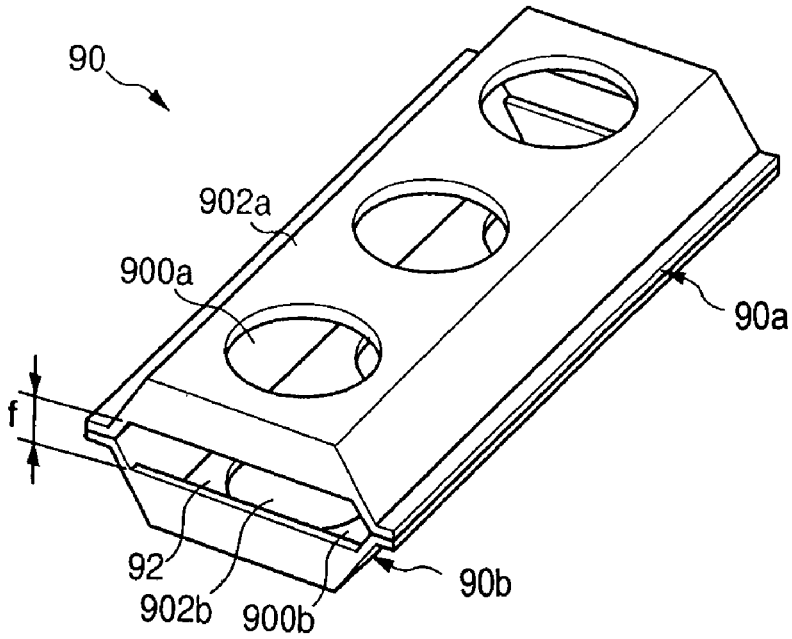
FIG. 11 is a perspective view of a multiple-element electrode for an electron gun according to another embodiment of the present invention.

FIG. 11 is a perspective view of a multiple-element electrode for an electron gun according to another embodiment of the present invention. Referring to FIG. 11, a multiple-element electrode 90 includes sub-electrodes 90*a* and 90*b*, a gap 92, surfaces 902*a* and 902*b*, and electron beam passage holes 900*a* and 900*b*. The electrode 90 is formed identically to the electrode 80 of FIG. 10, except that short ends of the sub-electrodes 90*a* and 90*b* are also bent in a direction toward each other when interconnected. Accordingly, a gap 92 is defined by the space between the short ends of the sub-electrodes 90*a* and 90*b*.

The multiple-element electrodes 80 and 90 are formed differently from the electrodes of the other embodiments described above. The size (e) of the gap 82 formed by the sub-electrodes 80*a* and 80*b* and a size (f) of the gap 92 formed by the sub-electrodes 90*a* and 90*b* are larger than a thickness of at least one of the sub-electrodes. That is, the size (e) or (f) is larger than a thickness of 80*a*, 80*b*, 90*a*, or 90*b*, thereby preventing deformation of the electrodes 80 and 90 by the electric field formed in the vicinity of the electrodes 80 and 90 during operation of the electron guns preventing generation of friction.

The electron gun for CRTs of the present invention structured and operating as described above, reduces the noise caused by friction between elements during operation of the CRT. As result, the quality of the images displayed by the CRT is significantly improved.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An electron gun for a cathode ray tube, comprising:

a triode portion including cathodes, a first electrode, and a second electrode arranged with predetermined gaps therebetween;

a plurality of electrodes arranged from a position adjacent the second electrode, wherein the plurality of electrodes are capable of receiving voltages;

an anode electrode arranged farthest away from the cathodes and having a predetermined gap from at least one of the plurality of electrodes; and a support for supporting the plurality of electrodes at predetermined intervals from each other, wherein one of the plurality of electrodes is a multiple-element electrode that includes a first sub-electrode and a second sub-electrode that are arranged having gaps formed between a portion of the first sub-electrode and a portion of the second sub-electrode, the first sub-electrode and the second sub-electrode being connected by having different dimensions of their opposing portions.

2. The electron gun for a cathode ray tube of claim 1, wherein at least one of the first sub-electrode and the second sub-electrode is cup-shaped.

3. The electron gun for a cathode ray tube of claim 2, wherein the first sub-electrode and the second sub-electrode are cup-shaped.

4. The electron gun for a cathode ray tube of claim 3, wherein at least one of the first cup-shaped sub-electrode and the second cup-shaped sub-electrode comprises:

a first container including electron beam passage holes;

a second container;

a flange extending around a circumference of an opening of the first container and the second container; and insertion members extending from at least a portion of the flange, wherein the insertion members are arranged into the support.

5. The electron gun for a cathode ray tube of claim 2, wherein the first sub-electrode is cup-shaped and the second sub-electrode are cup shaped and have at least one substantially identical dimension and the gap is formed between a surface of the first sub-electrode and the second sub-electrode.

6. The electron gun for a cathode ray tube of claim 5, wherein at least one protrusion is formed on at least one of the first cup-shaped sub-electrode and the second cup-shaped sub-electrode, and the first cup-shaped sub-electrode and the second cup-shaped sub-electrode are connected with the protrusions.

7. The electron gun for a cathode ray tube of claim 6, wherein a gap is formed between the first cup-shaped electrode and the second cup-shaped electrode.

8. The electron gun for a cathode ray tube of claim 5, wherein a predetermined gap is formed between areas of the first cup-shaped sub-electrode and the second cup-shaped sub-electrode that is adjacent to outermost electron beam passage holes.

9. The electron gun for a cathode ray tube of claim 1, wherein one of the first sub-electrode is cup-shaped and the second sub-electrode is plate-shaped.

10. The electron gun for a cathode ray tube of claim 5, wherein the first cup-shaped sub-electrode and the second plate-shaped sub-electrode have at least one substantially identical dimension and a gap is formed between circumferences of the first cup-shaped sub-electrode and the second plate-shaped sub-electrode.

11. The electron gun for a cathode ray tube of claim 1, wherein the plurality of electrodes receive a constant voltage.

12. The electron gun for a cathode ray tube of claim 1, wherein the plurality of electrodes receive a dynamic voltage.

13. The electron gun for a cathode ray tube of claim 12, wherein the dynamic voltage is synchronized with a deflection signal of electron beams.

14. An electron gun for a cathode ray tube, comprising:

a triode portion including a cathode, a first electrode, and a second electrode arranged in an in-line sequence with predetermined gaps therebetween;

a plurality of electrodes arranged at predetermined adjucent intervals, wherein the first of the plurality of electrodes is arranged adjacent the second electrode and the plurality of electrodes receive a voltage;

an anode electrode arranged in-line and being farthest from the cathode and having a gap from at least one of the plurality of electrodes; and a support for supporting the plurality of electrodes, the anode, the cathode, the first electrode and the second electrode at predetermined intervals from each other, wherein one of the plurality of electrodes is a multiple-element electrode that includes a first sub-electrode and a second sub-electrode that are arranged having gaps formed between a portion of the first sub-electrode and a portion of the second sub-electrode for reducing noise during operation of the cathode ray tube, wherein the first sub-electrode and the second sub-electrode are connected by having different dimensions of their opposing portions.

15. The electron gun for a cathode ray tube of claim 14, wherein at least one of the first sub-electrode and the second sub-electrode is cup-shaped.

16. The electron gun for a cathode ray tube of claim 14, wherein the first sub-electrode and the second sub-electrode are cup-shaped .

17. The electron gun for a cathode ray tube of claim 14, wherein one of the first sub-electrode is cup-shaped and the second sub-electrode is plate-shaped.

18. The electron gun for a cathode ray tube of claim 14, wherein the first sub-electrode is cup-shaped and the second sub-electrode is cup shaped and both have at least one substantially identical dimension and the gap is formed between a surface of the first sub-electrode and the second sub-electrode.

19. The electron gun for a cathode ray tube of claim 14, wherein at least one protrusion is formed on at least one of the first cup-shaped sub-electrode and the second cup-shaped sub-electrode, and the first cup-shaped sub-electrode and the second cup-shaped sub-electrode are connected with the protrusions thereby forming a gap between the first cup-shaped sub-electrode and the second cup-shaped sub-electrode.

* * * * *